United States Patent [19]

Alevras

[11] 3,972,075

[45] Aug. 3, 1976

[54] HAIR STYLIST'S HAIRCUTTING HELMET

[76] Inventor: Constantino J. Alevras, 542 Gruman Court, Rivervale, N.J. 07675

[22] Filed: Apr. 21, 1975

[21] Appl. No.: 570,243

[52] U.S. Cl. ..... 2/174; 2/410; 132/45 R

[51] Int. Cl.[2] ..... A42B 1/08

[58] Field of Search ..... 132/9, 45 R; 2/2, 3 R, 2/174, 195, 171, 171.2, 171.3, 171.6; 30/133

[56] References Cited

UNITED STATES PATENTS

| | | | |
|---|---|---|---|
| 2,915,070 | 12/1959 | Benson | 132/45 R |
| 3,015,336 | 1/1962 | Caples | 132/45 R |
| 3,230,619 | 1/1966 | Felland | 132/45 R |
| 3,551,911 | 1/1971 | Holden | 2/3 R |

*Primary Examiner*—G. V. Larkin
*Attorney, Agent, or Firm*—Charles J. Speciale

[57] ABSTRACT

A hair stylist's haircutting helmet comprising a headpiece shaped to conform to and fit over the human head, the headpiece being provided with a plurality of openings to which vacuum suction may be applied in order to draw the underlying hair up through the openings so that it may be uniformly cut and shaped using the helmet as a guide to same. A method for vacuum suction haircutting to achieve a uniform cut and shape.

4 Claims, 9 Drawing Figures

HAIR STYLIST'S HAIRCUTTING HELMET

BACKGROUND OF THE INVENTION

1. Field of the Invention

This invention relates generally to hair styling aids and more specifically to a device for haircutting by vacuum suction and to a method of vacuum suction haircutting.

2. Description of the Prior Art

Haircutting is of course a well known art. However, it is also well known that the style of the haircut varies with the haircutter. Thus, some cuts are too short, some are too long, some are too irregular from person to person and even on the same person.

SUMMARY OF THE INVENTION

It is therefore among one of the principal objectives to provide a novel hair styling aid for stylish and uniform haircutting and a method for achieving the same.

In accord with the present invention there has now been provided a hair stylist's haircutting helmet for achieving a uniform cut and shape which comprises a headpiece adapted and shaped to conform to, and fit loosely over, the human head; the headpiece being provided with a plurality of variously directed openings to which vacuum suction is applied thereby forceably drawing the underlying hair up through the openings whence it may be cut by the operator as it emerges. A method of achieving a uniform haircut and shape by vacuum suction haircutting is also provided.

BRIEF DESCRIPTION OF THE DRAWINGS

The invention will be hereinafter more fully described with reference to the accompanying drawing which:

FIG. 5 is a side elevational view of same.

FIG. 6 is a front elevational view.

FIG. 7 is a rear elevational view.

FIG. 8 is a top plan view.

FIG. 9 is a bottom plan view.

DESCRIPTION OF THE PREFERRED EMBODIMENTS

Figure 1:
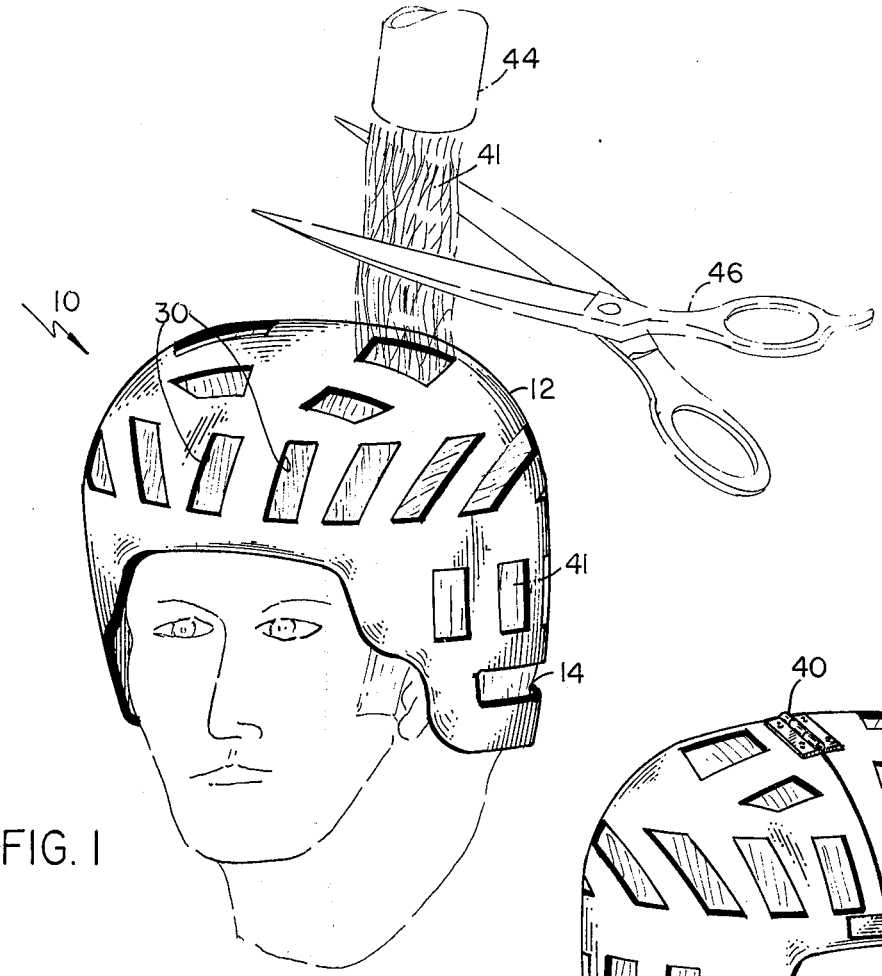
FIG. 1 is a view in perspective of the invention helmet, in one embodiment, and illustrating its use.

Referring now to the figures of the drawings and specifically to FIGS. 1 and 5 through 9, there is illustrated therein the hair stylist's haircutting helmet 10 of the invention, hereinafter referred to as "helmet". The helmet further comprises a headpiece 12 which is adapted and shaped to conform to, and fit loosely over the human head 14 of the subject shown by phantom lines. Thus, the headpiece 12 has a rounded top portion 16, opposing lateral curved sides 18 and 20, a front portion 22 which is cut higher than the rear portion 24. As will be readily apparent therefore, top portion 16 covers the top of the head, lateral sides 18 and 20 cover the temporal portion of the head, front portion 22 covers the forehead, and rear portion 24 covers the collar or neck portion. Headpiece 12 may be constructed of a hard plastic material, preferably, but not necessarily clear plastic.

Throughout the entire helmet there is provided a plurality of, preferably rectangular shaped openings 30. These openings 30 extend circumferentially around the helmet and are longitudinally oriented as in the top portion 16 shown by the numerals 32 and transversely oriented as in the front, rear and lateral portions as shown by the numerals 34. Openings 32 and 34 can be respectively parallel to an imaginary perpendicular horizontal and vertical bisector, respectively, drawn through the center of the helmet, or, as is preferable, can be slightly slanted therefrom. Along the rear portion 24 of the headpiece in a generally central location, there is provided an elongated rectangular horizontal slot 36. Slot 36 extends approximately the entire length of the collar portion of the head for a reason which will become more readily apparent hereinbelow.

Figure 2:
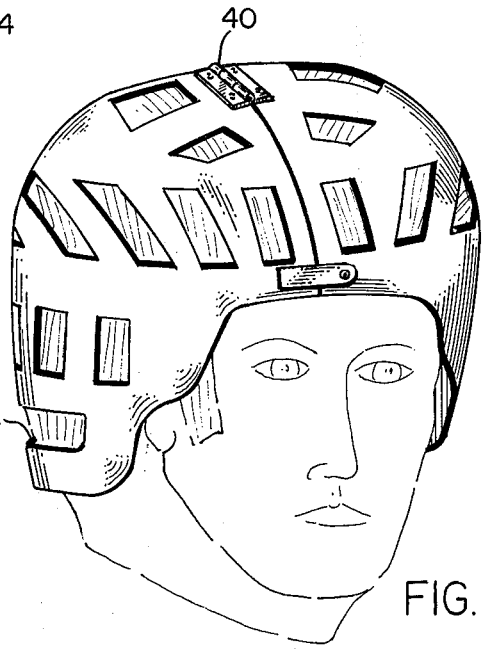
FIG. 2 is a view in perspective of the invention in another embodiment.
Figure 3:
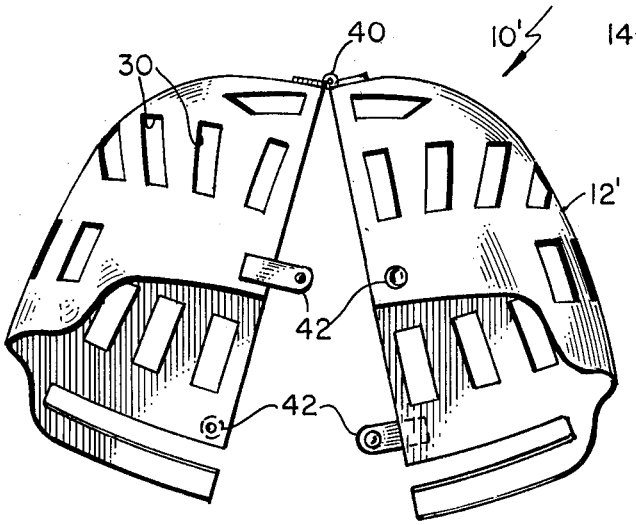
FIG. 3 is a front view of the embodiment shown in FIG. 2 and showing the helmet in the opened position before placement on the subject's head.

As mentioned earlier, the helmet of the invention can be adapted and shaped to conform and fit loosely over the human head of a subject. Fitting the helmet over the head can be made easier by providing a hinged, as at 40, two-pieced helmet 10′, illustrated by FIGS. 2 and 3. Once the helmet 10′ is fitted over the head the two pieces are secured together by a conventional snap-fit assembly 42, in front and rear. The other features of the invention, as described hereinabove, would remain constant.

Describing now the operation and method of invention what is done is to place the headpiece 12 or 12′ so that it fits loosely over the head 14 of the subject whose hair 41 is to be cut. Thereafter, the nozzle 44 of a vacuum cleaner hose which is attached to a suitable vacuum motor (hose and vacuum motor not shown) is brought to bear against, or in the immediate vicinity of the openings 30 and the vacuum motor is turned on. The hair 41 is sucked up and out of the openings in the direction of the resulting vacuum suction and the hair stylist then proceeds to cut the hair via the scissors 46. The stylist can shear the hair at the helmet line for a shorter cut or can cut higher up for a longer cut as desired. In this connection note FIG. 1 particularly. The operator or stylist proceeds to vacuum the hair as it were, at each opening, cutting as he moves along. Finally, at the collar slot 36 the hair is vacuumed out and trimmed as described.

Figure 4:
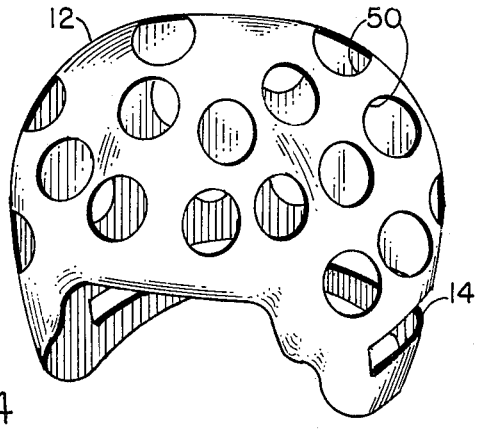
FIG. 4 is a view in perspective of yet another embodiment of the invention.
Figure 5:
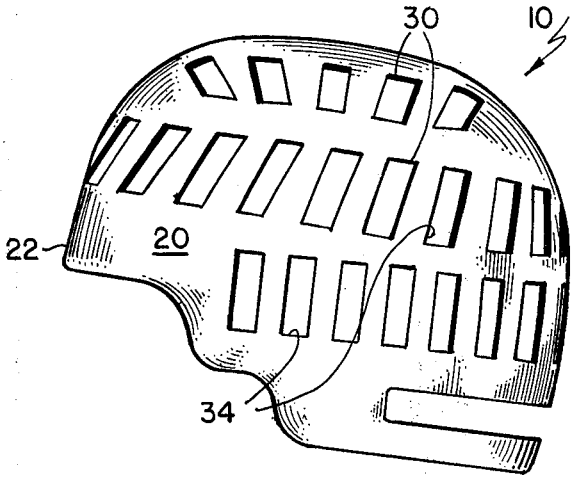
FIGS. 5–9 inclusive are various views of the embodiment shown by FIG. 1, and specifically.
Figure 7:
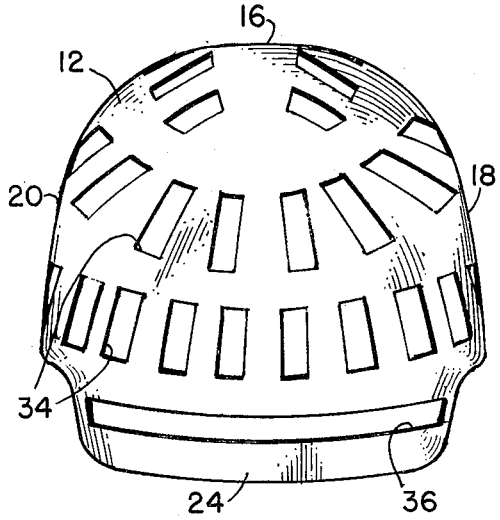
Figure 6:
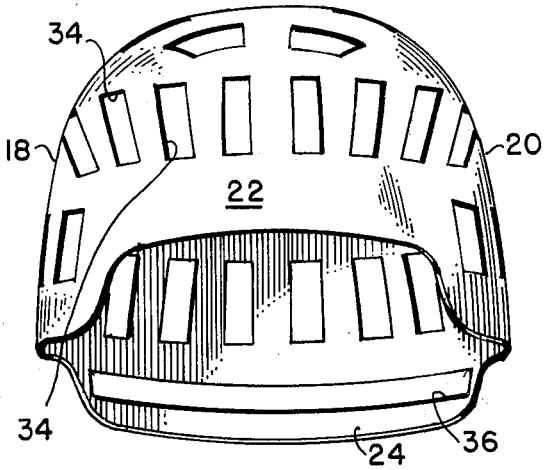
Figure 8:
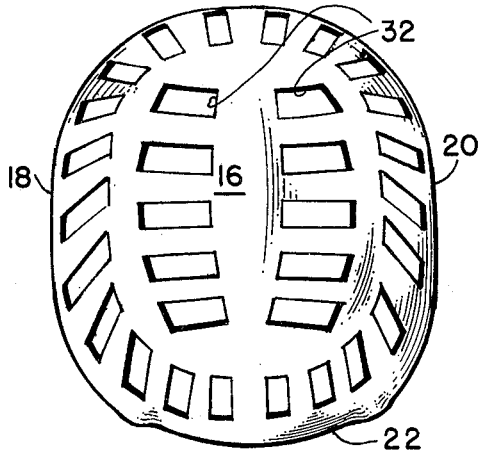
Figure 9:
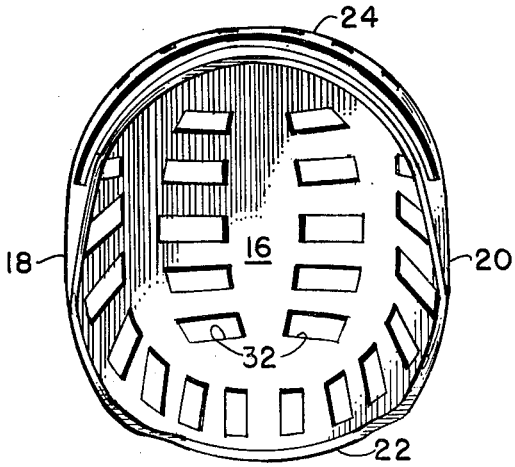

FIG. 4 shows yet another embodiment of the invention whereby the former openings 30 instead of being elongated are round holes 50 instead. Slot 14 remains the same. The openings 30 and 50 are uniformly spaced apart, naturally, to achieve a more uniform cut.

By virtue of the fact that the helmet may be made of clear plastic this allows the operator to observe his progress in cutting the hair and by its loose fit over the head, the suction force may be maximumly effective.

Thus, there is achieved by this apparatus and method, a haircut of uniform cut and shape with very little variation, if any, from stylist to stylist. It is a simple method, yet it produces a very attractive haircut.

What is claimed is:

1. A hair stylist's haircutting helmet which comprises a head piece adaptable to and shaped to conform to and fit over the head and hair, said headpiece being further provided with a plurality of variously directed, uniformly spaced openings through which a suction force may be applied to said hair so that it is forceably drawn up and through the openings thereby freeing said hair for cutting and wherein said head piece further comprises a rounded top portion, a pair of opposing inwardly curved lateral sides, a front portion and a rear portion, said front portion being shorter than said rear portion, said rounded top being further provided with a plurality of horizontally oriented rectangular shaped openings, said lateral sides, front and rear portions being further provided with a plurality of vertically oriented circumferential spaced, rectangular shaped openings, and said rear portion being still further provided with a longitudinally oriented, elongated, rectangularly shaped slot all of through which openings said hair may be drawn.

2. A helmet according to claim 1 wherein said headpiece is transversely divided along a mid-line running from front to rear forming two halves, a hinge also being provided, said hinge further comprising two hinge leads, one hinge lead being connected to one of said halves, the other hinge lead being connected to the other of said halves so that said helmet is adapted to hingeably open and securing means provided comprising a snap fastener so that said halves may be detachably secured.

3. A hair stylist's haircutting helmet which comprises a head piece adaptable to and shaped to conform to and fit over the head and hair, said headpiece being further provided with a plurality of variously directed, uniformly spaced openings through which a suction force may be applied to said hair so that it is forceably drawn up and thereby freeing said hair for cutting and wherein said headpiece further comprises a rounded top portion, a pair of opposing inwardly curved lateral sides, a front portion and a rear portion, said front portion being shorter than said rear portion, said rounded top, opposing lateral sides, front and rear portions being still further provided with a plurality of uniformly spaced circular openings, and said rear portion being still further provided with a longitudinally oriented, elongated, rectangularly shaped slot all of through which openings said hair may be drawn.

4. A helmet according to claim 3 wherein said headpiece is transversely divided along a mid-line running from front to rear forming two halves, a hinge also being provided, said hinge further comprising two hinge leads, one hinge lead being connected to one of said halves, the other hinge lead being connected to the other of said halves so that said helmet is adapted to hingeably open and securing means provided comprising a snap fastener so that said halves may be detachably secured.

* * * * *